US010605543B2

(12) United States Patent
Schnabel et al.

(10) Patent No.: US 10,605,543 B2
(45) Date of Patent: Mar. 31, 2020

(54) HEAT TRANSFER DEVICE HAVING CHANNELS

(71) Applicant: FRAUNHOFER GESELLSCHAFT ZUR FÖRDERUNG DER ANGEWANDTEN FORSCHUNG E.V., München (DE)

(72) Inventors: Lena Schnabel, Freiburg (DE); Eric Laurenz, Freiburg (DE); Hannes Fugmann, Freiburg (DE); Steffen Kaina, Dresden (DE); Thomas Studnitzky, Dresden (DE); Friedrich A. Roell, Neu-Ulm (DE); Kurt Hattler, VS-Schwenningen (DE)

(73) Assignee: FRAUNHOFER GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 64 days.

(21) Appl. No.: 15/310,952

(22) PCT Filed: Apr. 13, 2015

(86) PCT No.: PCT/EP2015/057962
§ 371 (c)(1),
(2) Date: Nov. 14, 2016

(87) PCT Pub. No.: WO2015/172954
PCT Pub. Date: Nov. 19, 2015

(65) Prior Publication Data

US 2017/0089647 A1 Mar. 30, 2017

(30) Foreign Application Priority Data

May 12, 2014 (DE) ..... 10 2014 208 955

(51) Int. Cl.
*F28F 1/12* (2006.01)
*F28F 3/02* (2006.01)
(Continued)

(52) U.S. Cl.
CPC ..... *F28F 1/122* (2013.01); *F28F 3/022* (2013.01); *F28F 13/003* (2013.01); *F28F 21/00* (2013.01); *F28F 2215/04* (2013.01)

(58) Field of Classification Search
CPC ..... F28F 2215/04; F28F 1/122
(Continued)

(56) References Cited

U.S. PATENT DOCUMENTS 2,595,457 A * 5/1952 Jensen ..... F28F 3/022 165/145
3,313,343 A 4/1967 Ware et al.
(Continued)

FOREIGN PATENT DOCUMENTS

DE 675 464 C 5/1939
DE 27 02 337 A1 7/1978
(Continued)

OTHER PUBLICATIONS

International Search Report issued in PCT/EP2015/057962; dated Jun. 29, 2015.
(Continued)

*Primary Examiner* — Paul Alvare
(74) *Attorney, Agent, or Firm* — Studebaker & Brackett PC

(57) ABSTRACT

The invention relates to a heat transfer device with channels for heat-absorbing media and channels for heat-emitting media, at least one of the channels having a textile structure with compressed and non-compressed regions. Whilst the compressed regions are disposed in the transition regions between the channels in order to improve the heat transfer to
(Continued)

or across the channel wall, the non-compressed regions are disposed in the flow regions of the channels. This construction enables a large heat transfer to the heat transfer surface with simultaneously good heat conduction from the heat transfer surface to the separating surface. The invention likewise relates to heat exchangers with heat transfer devices of this type.

15 Claims, 6 Drawing Sheets

(51) Int. Cl.
*F28F 13/00* (2006.01)
*F28F 21/00* (2006.01)

(58) Field of Classification Search
USPC ..... 165/146, 147
See application file for complete search history.

(56) References Cited

U.S. PATENT DOCUMENTS 3,818,984 A * 6/1974 Nakamura ..... F28D 9/0018 165/166
6,994,155 B2 2/2006 Dessiatoun et al.
7,255,159 B2 * 8/2007 Sagasser ..... B21D 13/02 165/166
2005/0274501 A1 * 12/2005 Agee ..... F28D 9/0062 165/146
2006/0126308 A1 6/2006 Campbell et al.
2006/0137856 A1 6/2006 Popovich
2012/0261106 A1 * 10/2012 Kelly ..... F28F 3/022 165/185
2014/0116664 A1 * 5/2014 Landre ..... F28F 3/025 165/166

FOREIGN PATENT DOCUMENTS

DE 31 24 379 A1 2/1983
DE 34 27 251 A1 1/1986
DE 10 2006 022 629 A1 11/2007
DE 10 2008 063 700 A1 6/2010
EP 0 151 213 A1 8/1985
GB 909 142 A1 10/1962
WO 98/31976 A1 7/1998
WO 2011/137522 A1 11/2011
WO 2012/141793 A1 10/2012

OTHER PUBLICATIONS

Written Opinion issued in PCT/EP2015/057962; dated Jun. 29, 2015.
Translation of the International Preliminary Report on Patentability issued in PCT/EP2015/057962; dated Nov. 24, 2016; 6pp.
Office Action issued in corresponding European Patent Application No. 15717147.1 dated Dec. 6, 2018; 5pp.

* cited by examiner

HEAT TRANSFER DEVICE HAVING CHANNELS

The invention relates to a heat transfer device with channels for heat-absorbing media and channels for heat-emitting media, at least one of the channels having a textile structure with compressed and non-compressed regions. Whilst the compressed regions are disposed in the transition regions between the channels in order to improve the heat transfer to or across the channel wall, the non-compressed regions are disposed in the flow regions of the channels. This construction enables a large heat transfer to the heat transfer surface with simultaneously good heat conduction from the heat transfer surface to the separating surface. The invention likewise relates to heat exchangers with heat transfer devices of this type.

In the case of the phenomenon of heat transfer, surface increase is of central importance.

For example the following objectives are in the forefront:

- equalization of greatly different heat transfer coefficients, by an increased surface being made available for heat transfer in the medium on the side with the lower heat transfer coefficient (e.g. air),
- increase in the power density of heat exchangers by means of a more compact construction,
- increase in the heat transfer in the case of boiling processes,
- optimisation of the heat- and material transport kinetics in the case of sorption processes/chemical reactions or catalytic processes,
- assistance to capillary transport processes, and
- humidifying and dehumidifying of air and other gases.

According to the application, the increase in power density (corresponds to reduction in constructional volume and/or the material use), the reduction in the operating temperature differences, the reduction in pressure loss, the increase in yield due to reduced cycle times or a combination of these values is of interest.

For heat exchangers with large specific surfaces, nowadays above all attached or soldered lamellar heat exchangers, consisting of copper tubes and attached copper-, aluminium- or stainless steel lamellae and also flat tube-based aluminium coolers, in which folded lamellae with extruded fluid channels are soldered, are of importance.

In order to achieve an energy-efficient, component-compact and material-saving heat transfer in flowing media, it is of central importance to achieve a high volume-specific surface and also as large as possible and as integral as possible a contact surface between the separating surface and the surface increase. At the same time, it is important to design the paths of the heat conduction through the surface increase structure to be as short and direct as possible. By means of corresponding slots, bulges, undulations etc. in the surface increase structure, it is attempted to achieve as high a surface-specific heat transfer as possible without disproportionately increasing the pressure loss to be overcome. The values which are achieved here by the currently available heat exchangers are compiled in table 1.

TABLE 1

| | volume-specific surface area [$m^2/m^3$] | contact surface for the fluid structure [$m^2/m^3$] | type of contacting |
|---|---|---|---|
| lamellae (flat, stamped) | 1,250 | 55 | pressed |

TABLE 1-continued

| | volume-specific surface area [$m^2/m^3$] | contact surface for the fluid structure [$m^2/m^3$] | type of contacting |
|---|---|---|---|
| folded/undulated lamellae | 1,340 | 65 | integral (soldered) |
| metallic short fibres | 8,000-10,000 | 100 | soldered/ sintered |

A further possibility for the production of large specific surfaces and integral contacting to the separating surface are represented by metallic short fibre structures. These are piled onto each other, compressed and subsequently soldered or sintered. By varying the fibre length and diameter, a variation in density and porosity is achievable. They reach volume-specific surfaces of 8,000-10,000 $m^2/m^3$ and volume-specific separating surfaces between the two media in the range of 100 $m^2/m^3$. For use in flowing media, the non-defined orientation and arrangement of the fibres is however disadvantageous.

Combination of fibre mats and tubes likewise represents a possibility for increasing surfaces.

In DE 27 02 337 A1, the combination of flexible tubes and fibre mats is described, in order to produce e.g. surface heating units. The focus of the invention resides however on the flexible tube layout, the fabric is defined merely as carrier structure and not as specifically designed heat transfer structure.

In DE 31 24 379 A1, a wire mesh is described, which is processed either by soldering to tubes or by weaving throughflowable tubes to form a heat exchanger. The fabric is thereby structured uniformly, a geometric design is effected by processing, at points, of fairly thick wires or by folding the fabric mat. A dirt-repellent coating by Teflon is mentioned. Wire spacings and diameters are not specified in more detail.

Similarly thereto, a fabric with woven-in copper tubes is described in DE 34 27 251 A1. The structure is proposed for use as low-temperature heating element. The connection technique, wire spacings and diameters are not specified in more detail.

In DE 10 2006 022 629 A1, a heat exchange device for heat exchange between media is proposed, with which the heat exchange device is supplied, the media not coming in contact with each other and at least one tube being provided for one medium. The invention is distinguished by the tubes being integrated in a woven structure.

In WO 98/31976 A1, a heat exchanger element is described, in the case of which the heat transfer is achieved by bar ribs which are perpendicular in the flow and at an equal spacing from each other. As suitable dimensions, the bar cross-section is indicated at 4 $mm^2$ and the ratio of bar diameter/length at 0.3. In the description for implementation, fabric and knitted fabric are mentioned as preferred material and described both for the wall and for the production of the bar structure. Thus, the bars are also conceivable, e.g. in the form of loops.

In U.S. Pat. No. 3,313,343 A, a surface increase is described by means of a folded, unstructured, diagonally woven, metal sieve. The metal fabric is placed between two flat plates guiding the fluid so that fluid channels are formed by the folded fabric.

In WO 2012/141793 A1, a general hierarchically structured surface increase for heat exchangers with flat plates is described. The surface increase forms channels in the flow direction of the fluid and becomes thicker with increasing spacing relative to the plate.

In WO 2011/137522 A1, a method for the production of heat exchangers made of discs is described, which discs were cut from a block of layered fabric. The surfaces of these discs are sealed by coating processes so that media separation is achieved without additional separating elements (plates, foils).

The technical problem underlying the present invention resides in non-optimal adaptation of available surface increases to the respective problem and construction situation. The requirement for high heat transfer power with low operating temperature differences and low pressure losses with low material use in a small constructional space has to date not been fulfilled adequately by the solutions known from the state of the art. Hence, there is an increased consumption of material and energy for overcoming the pressure losses.

It was hence the object of the present invention to provide devices for heat transfer which fulfil in fact these requirements for reduced material- and energy consumption with simultaneously high heat transfer power and, at the same time, can be produced in a simple and economic manner.

According to the invention, a heat transfer device is provided, which has at least one channel for a heat-absorbing medium and at least one channel for a heat-emitting medium. At least one of these channels thereby has a textile structure at least in regions, the textile structure having compressed regions at regular spacings, the compressed regions of the textile structure being disposed in the transition region between at least one channel for a heat-absorbing medium and at least one channel for a heat-emitting medium for the production of a thermal contact between these channels. Furthermore, non-compressed regions of the textile structure are disposed in the flow region of at least one channel.

Within the scope of the present invention, there should be understood by the term channel, also those regions which have a channel-like configuration but, because of the filling with a solid material, e.g. PCM, no longer represent a channel or, as e.g. in the case of planar heating structures, are open towards the surroundings.

The textiles structures used according to the invention enable very large heat transfer surfaces. These are orientated such that a high heat transfer to the heat transfer surface and good heat conduction from the heat transfer surface to the separating surface is achieved at the same time. In the case of permeated heat transfer devices, the flow is thereby disturbed only as far as it serves to improve the heat transfer.

With the heat transfer device according to the invention, the advantage is associated that, with simultaneous use of material and constructional volume, less energy need be consumed for the same heat transfer. With the same use of energy and constructional volume, less material need be used for the heat transfer device according to the invention and, with the same use of energy and material, the constructional volume can be reduced.

A preferred embodiment provides that the channels for the heat-absorbing media are separated from the channels for the heat-emitting media by a separating wall, in particular a metal sheet, a film, a membrane or the outer surface of a tube or hose.

It is thereby preferred that the compressed regions in the transition region of the channels are connected integrally to the separating wall at least in regions, in particular by gluing, soldering, welding, sintering or casting.

A further embodiment according to the invention provides that the textile structure at the compressed regions has a coating which is impermeable for the media.

A further embodiment according to the invention relates to a heat transfer device for separation of adjacent channels, in at least one channel, an expandable hose or tube which is impermeable for the media is integrated and/or, around at least one channel, a shrinkable hose or tube which is impermeable for the media is disposed, which enable contacting to the textile structure by widening and/or shrinking.

The textile structure disposed in at least one channel can preferably be permeated, at least in regions, by a fluid for heat exchange. In a further variant, the textile structure can be embedded, at least in regions, in a latently heat-storing, sorptive or catalytic stationary medium.

A further preferred embodiment provides that the textile structures of channels adjacent to each other have different wire lengths and/or spacings of the wires in the separating surface plane.

The non-compressed regions can thereby preferably be varied such that the flow resistance in the channel is adjustable via the wire lengths, wire diameters and/or spacings of the wires. This can be used in particular for the purpose of producing diagonally approached structures with secondary channels situated between. In comparison with the inflow rate, the flow rate through the textiles structure with which the diagonal structures are permeated is reduced. When flowing around the textile structures according to the invention with low fibre-, yarn or wire diameters, large heat transfers can in fact be achieved with low flow rates. Thus, the more slowly permeated diagonal structures lead to an advantageous reduced pressure loss with simultaneous transfer density or to an advantageous higher transfer density with the same pressure loss. The diagonally approached region can include in general compressed and non-compressed textile structures and also possibly separated heat-transfer media which flow in the plane of this region.

Such an arrangement of fabric structures is possible in particular if the structures are produced to be planar, i.e. with a small throughflow depth. A fold in these planar structures into the desired form can be effected in a second production process. Production of a secondary, structure-free channel by means of corresponding folding of the structure is not restricted to textile structures. This can also be achieved by other permeable heat transfer structures, in particular lamellae, sponges, foams, sintered fibre structures or homogeneous textile structures. Hence, a comparable advantageous heat transfer behaviour can be achieved.

The textile structure thereby preferably consists of wires, technical fibres or yarns hereof with a preferred diameter of 10 μm to 2 μm, particularly preferably of 80 μm to 300 μm. The wires, technical fibres or yarns hereof thereby have, in flow direction, preferably a spacing of 20 μm to 20 mm, preferably of 40 μm to 10 mm and particularly preferably of 100 μm to 4 mm.

The wires, technical fibres or yarns hereof are preferably selected from the group consisting of

- metallic materials and the alloys thereof, in particular copper, aluminium or stainless steel,
- carbon-containing materials, in particular carbon fibres, activated carbon fibres,
- glass- and ceramic fibres,
- polymer materials, in particular polypropylene (PP), polyethylene (PE), polyamide (PA), polyether ketones (PEK), polyester (PET) and
- composite materials hereof.

The textile structure preferably has intrinsic rigidity which enables a self-supporting construction of the heat exchanger.

Preferably, the textile structure consists of a woven, knitted or warp-knitted structure or combinations hereof.

Furthermore, it is preferred that the fabric structure used was coated galvanically with a solder and, by melting the solder, the intrinsic stability of the structure and the integral connection at the node points of the wires is implemented to each other and to the separating surface.

A preferred embodiment provides that, in the heat transfer device, lighting elements, in particular optical fibres or elements having LEDs, are integrated, preferably in the form of incorporated wires, fibres or yarns.

Likewise it is possible that, in the heat transfer device, at least one heating wire, in particular made of copper, copper-nickel alloys, nickel-chromium alloys, constantan, manganin, nickel-iron alloys or kanthal, is integrated.

According to the invention, a heat exchanger is likewise provided, which comprises a heat transfer device according to the invention, as was described previously. The heat exchanger thereby preferably concerns a plate heat exchanger, a tubular heat exchanger, a tubular lamellar heat exchanger, a flat tube lamellar heat exchanger or a coaxial heat exchanger.

The heat transfer devices according to the invention are used in particular in heat transfer to/from air or other gaseous media (e.g. recirculation cooler, exhaust gas heat exchanger, convectors, ventilation devices, oil coolers, etc.), in heat transfer to/from water or other liquid media, in applications with phase change (evaporation, condensation, solid/liquid) and also in combination with sorption materials or catalytic coatings.

The subject according to the invention is intended to be explained in more detail with reference to the subsequent Figures without wishing to restrict said subject to the specific embodiments shown here.

FIGS. 1*a* to 1*c* show the textile structure according to the invention with reference to two embodiments in the flat and in the folded state.

FIGS. 2*a* and 2*b* show a first flat embodiment and a second tubular embodiment of the heat transfer device according to the invention.

FIGS. 3*a* and 3*b* show a variant of a heat transfer device according to the invention, with a combination of various textile structures and in combination with a collector.

FIGS. 4*a* and 4*b* show a variant of the textile structure with different wire spacings and wire lengths in the permeated region.

FIGS. 8*a* to 8*d* show examples of structured surfaces according to the invention.

Figure 1A:
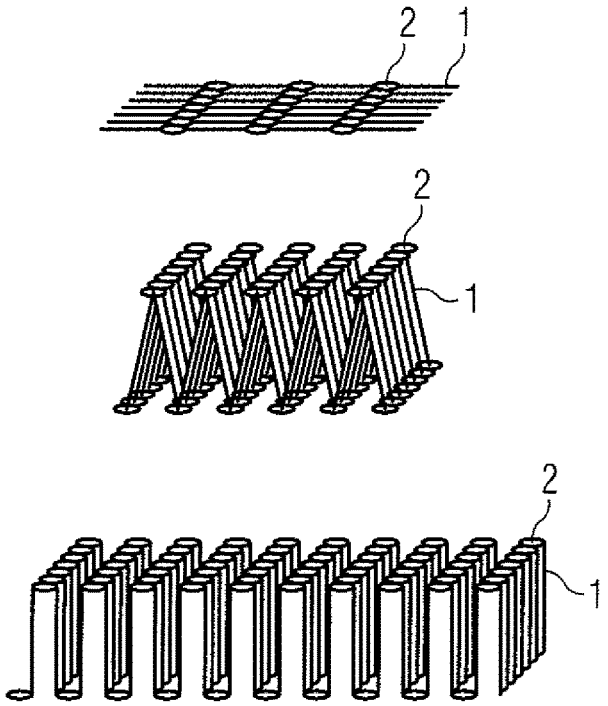
Figure 1B:
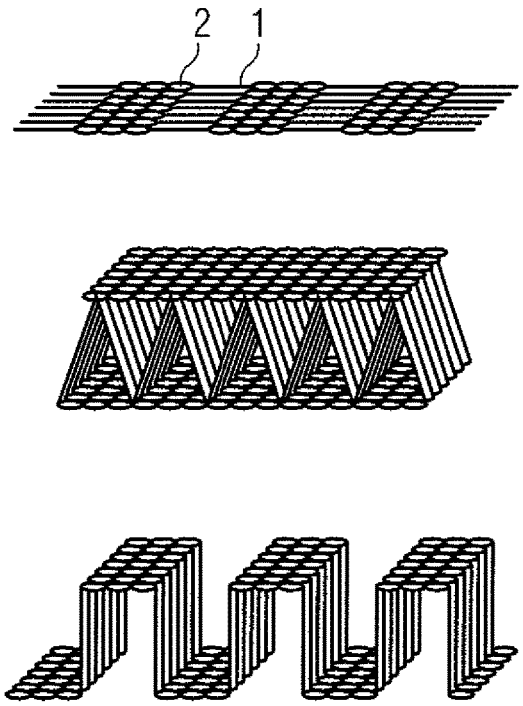
Figure 1C:
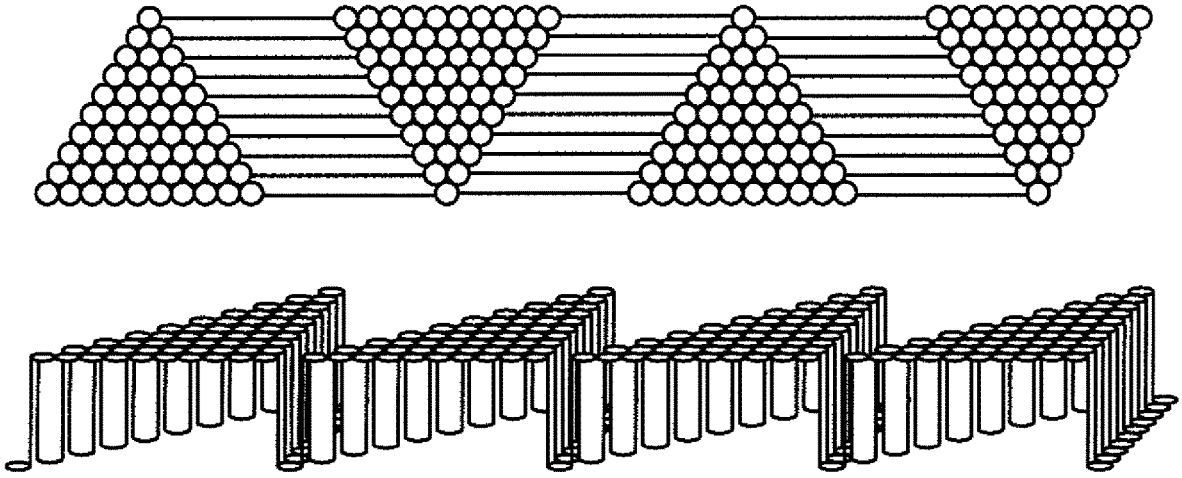

In FIG. 1*a*, a flat fabric made of wires is illustrated on the left-hand side, which fabric has non-compressed regions (1) and more narrowly manufactured wire regions (2). By folding this structure, a spacing structure which configures a flow channel and two top surfaces is produced. Two examples of such a spacing structure are illustrated in FIG. 1*a* in the central part and the lower part. Whilst in the central part of the Figure, the wires of the non-compressed region are disposed diagonally, in the lower part of FIG. 1*a*, the wires are disposed parallel to each other and perpendicular to the formed wall surface. In FIG. 1*b*, a comparable embodiment is illustrated, in which however the more narrowly manufactured regions (2) turn out to be larger relative to the regions with long wire spacings (1). In the case of the embodiment shown in FIG. 1*c*, the folding leads to tapering secondary channels. The non-compressed regions situated between the secondary channels of the textile structure are permeated at a lower normal speed compared with the inflow speed such that a lower pressure loss is achieved. The formed wall surfaces can be connected to a separating wall by one of the joining methods mentioned above or can be coated directly impermeably.

Figure 2A:
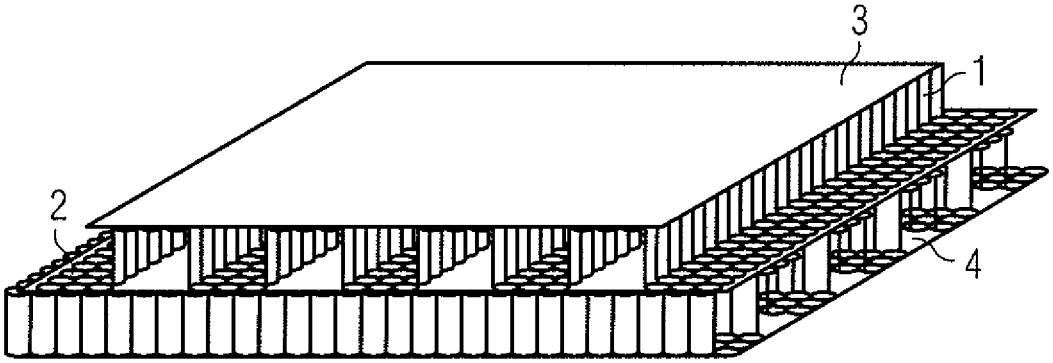

In the flat embodiment shown in FIG. 2*a*, the above-illustrated folded structure on the wall surfaces is contacted to a separating surface (3) which was configured as a metal sheet or foil via soldered joints (4). On the other side of the separating wall, the same textile structure is situated, rotated by 90°, so that this element can be used for example in a counter-current plate heat exchanger.

Figure 2B:
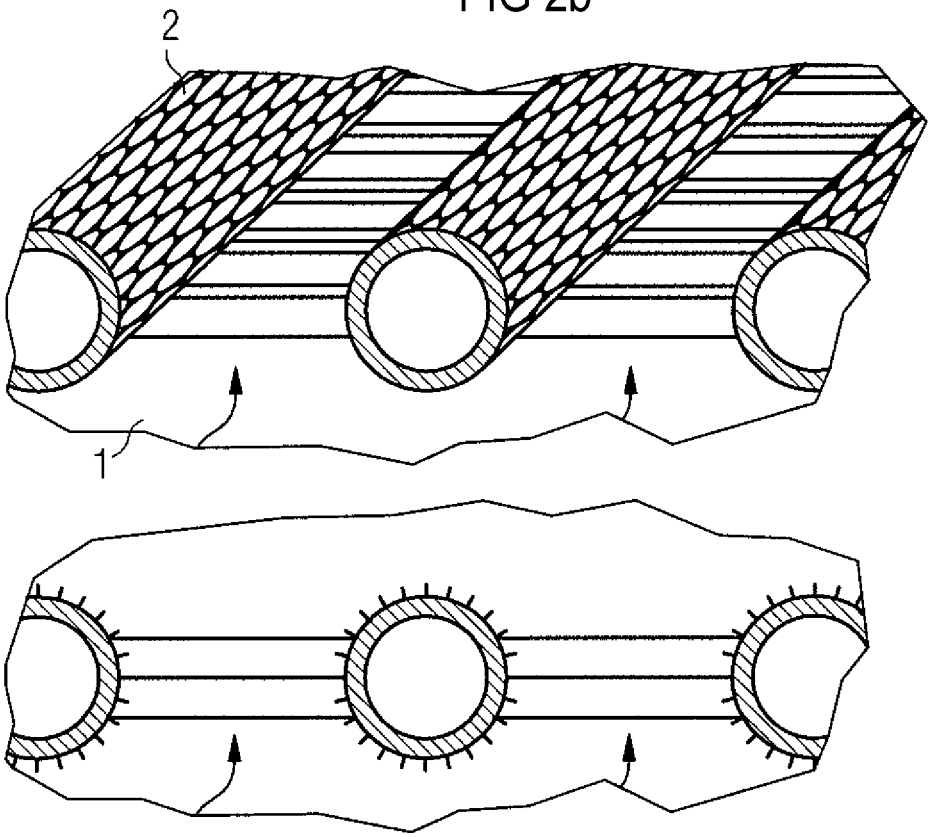

In the tubular embodiment shown in FIG. 2*b*, the compressed regions of the textile structure (2) form a hose-like form which is applied on a separating wall configured by tubes from outside. The non-compressed regions (1) thus form the surface-increasing structure in the region between the tubes. This structure can be permeated for example perpendicular to the tubes and wires for heat exchange.

Figure 3A:
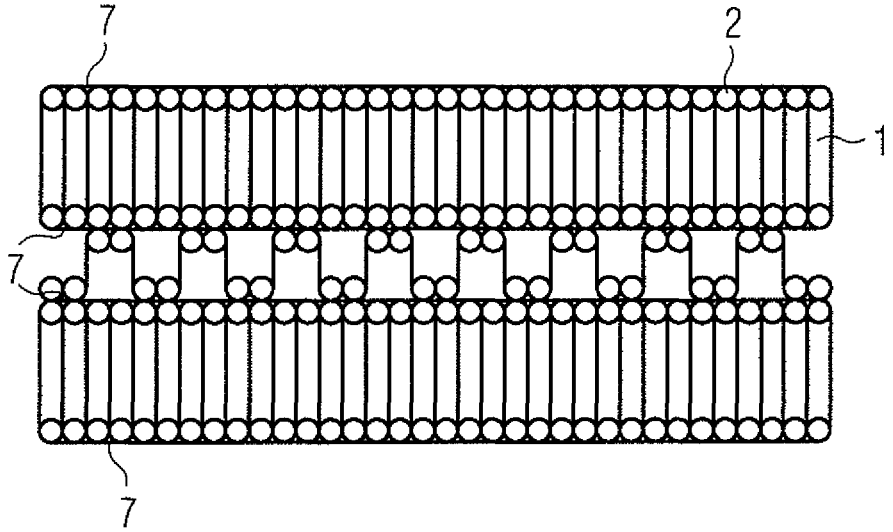

As indicated in FIG. 3*a*, the dimensioning of the flow structures can be adapted flexibly to the corresponding media or flow conditions separated via separating surfaces (7). Thus, it is conceivable, for example, that the dimensions of the wire spacings and heights are different for different sides of the heat exchanger.

Figure 3B:
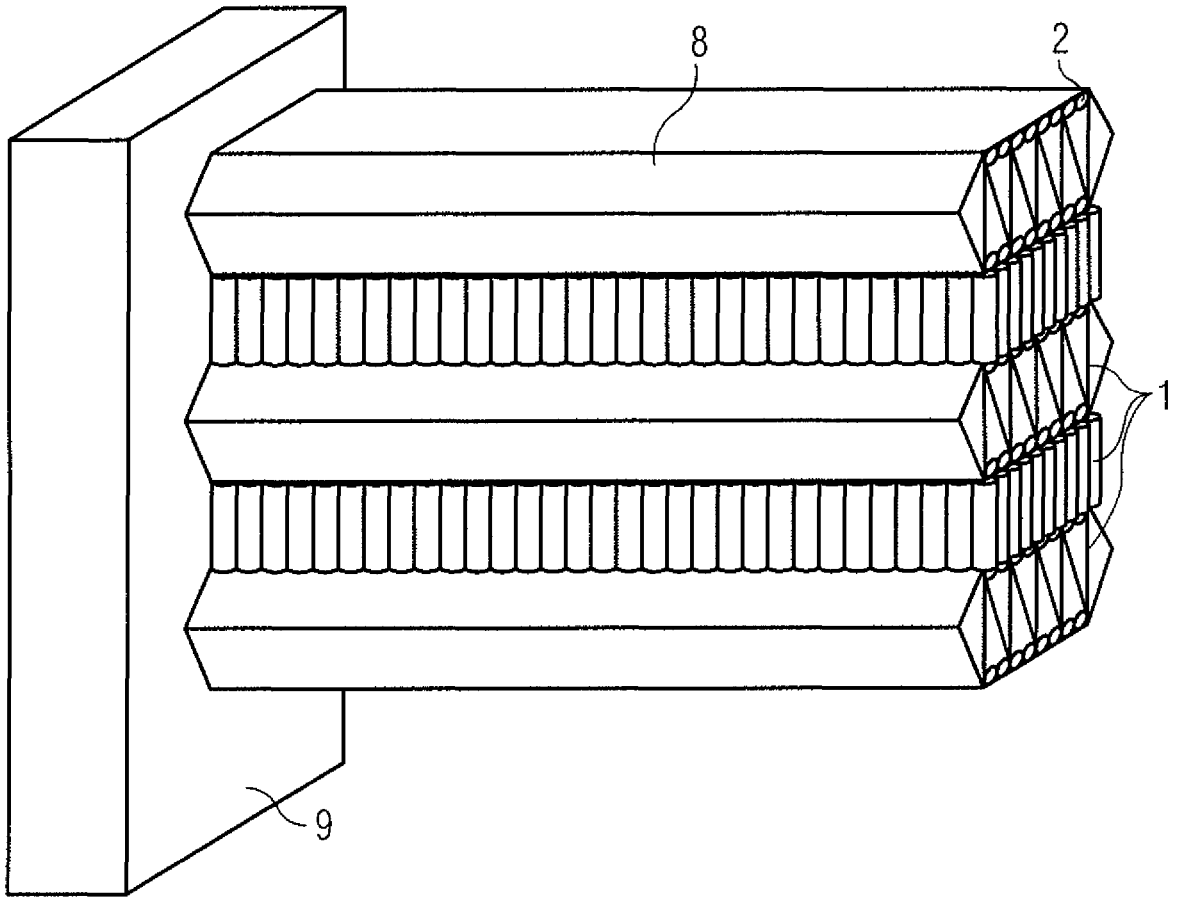
Figure 4A:
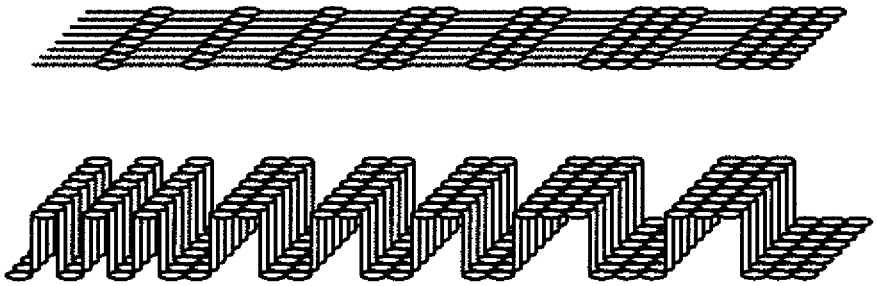
Figure 4B:
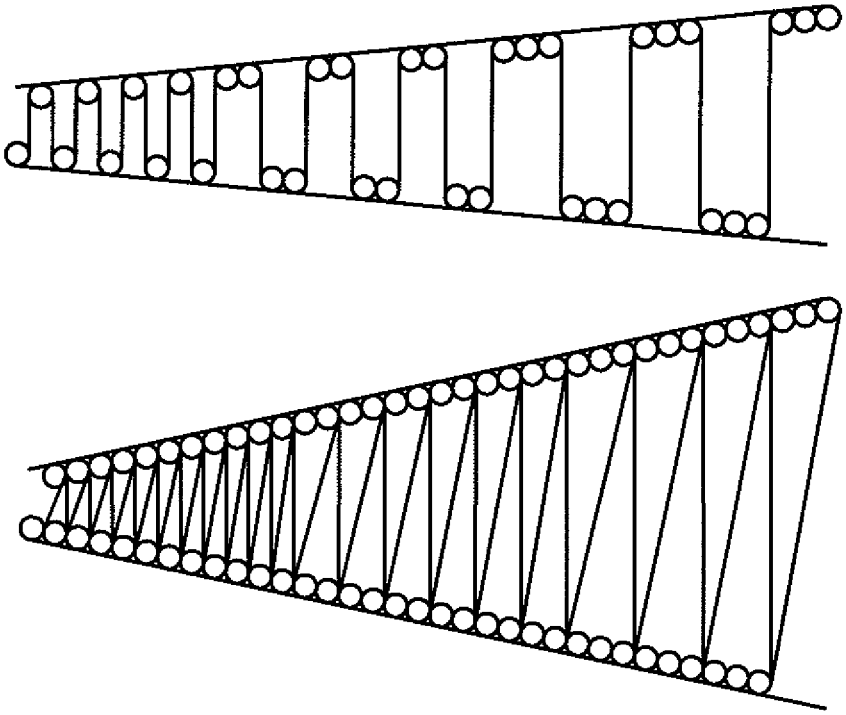

One possibility for use hereof is shown in the embodiment in FIG. 3*b*. Here, the one side of the separating surface (8) is completely surrounded so that permeable flat pipes are configured, to which the one medium is distributed via a collector (9). The other medium flows perpendicularly through the other folded structures situated between the flat tubes. As an advantage relative to conventional flat tubes, the stabilising spacing structures permit use of very thin separating walls. Because of the folding technique however and also with the textile manufacturing technique, defined structured regions of different densities can also be produced in one medium (FIG. 4*a*), e.g. in order to compensate for unequal speed distributions in the inflowing medium, to control specifically temperature gradients of the second medium or to meet complex geometric requirements. As shown in FIG. 4*b*, the top surfaces need not thereby necessarily be parallel.

Figure 5:
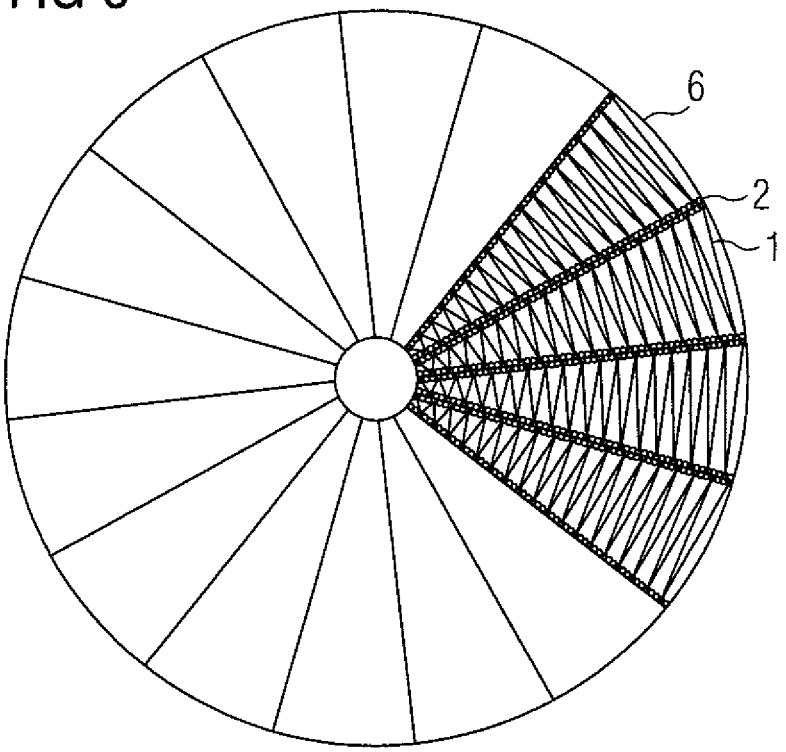
FIG. 5 shows a variant according to the invention of a coaxial heat exchanger using the previously (FIG. 4*b*) shown elements.

In FIG. 5, a coaxial heat exchanger with a circumferential outer shell 6 is illustrated, the individual segments of the tubular cross-section being filled with the textile structure according to the invention. Here, the non-compressed regions 1 and the separating wall 2, on which the compressed regions are situated, can be detected. The segments are thereby permeated with one or the other medium alternately so that one medium flows in and the other medium out of the image plane.

Figure 6:
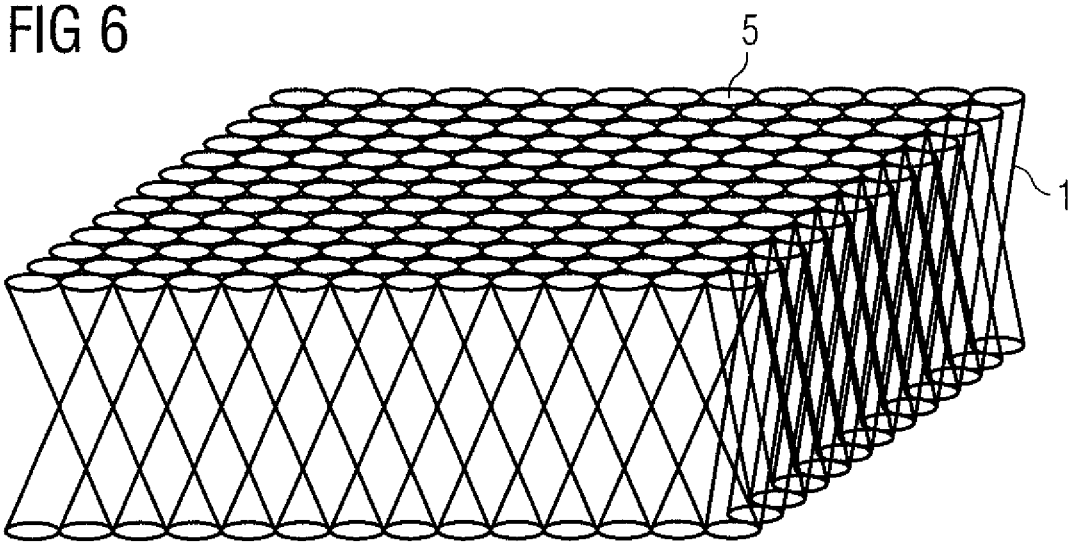
FIG. 6 shows a further embodiment of a textile structure according to the invention.

It is also possible, from a technical manufacturing point of view, to produce flow structures which are produced in one manufacturing step (see FIG. 6), the non-compressed wires (1) can thereby be disposed diagonally relative to each other. The connection to the top surface (5) can be achieved for example by knitting processes. As a result of the diagonal position of the wires, increased intrinsic stability of the structure is achieved. The reduction in manufacturing steps is an attractive feature here also, however, the thermal masses must be considered.

Figure 7:
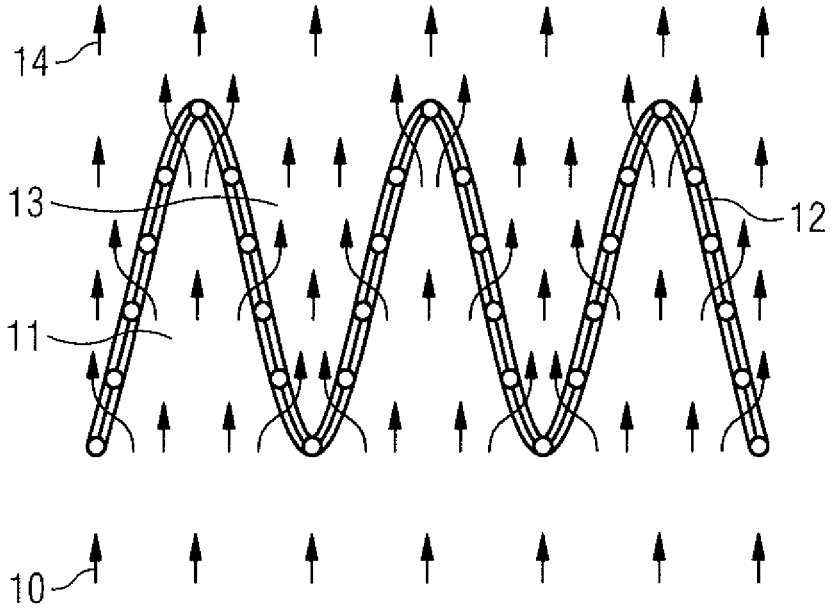
FIG. 7 shows a further embodiment of the textile structure according to the invention.

In FIG. 7, an arrangement of the textile structures as heat exchangers is represented. The region of the textile structure is given for example by the structure illustrated in FIG. 2*b*. One of the heat-exchanging media flows firstly through the inflow region of the heat exchanger (10), then through the structure-free secondary channel region (11) towards the textile structure (12). This is permeated by the medium at lower speeds than in the inflow region since the surface to be permeated is greatly increased by folding the structures. The medium subsequently flows through the outflowing structure-free channels (13) into the outflow region (14).

Figure 8A:
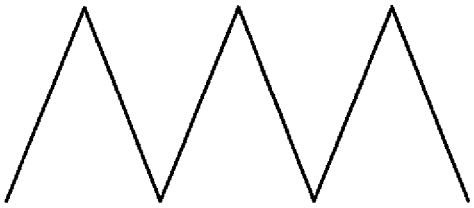
Figure 8B:
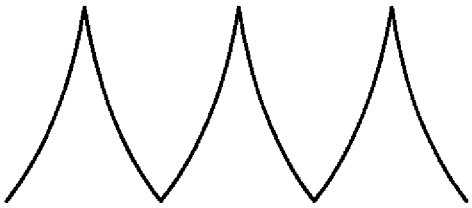
Figure 8C:
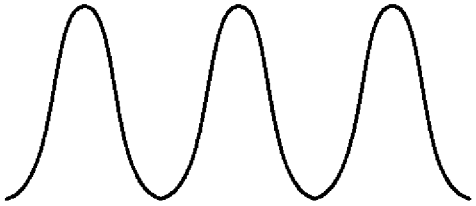

In FIGS. 8*a* to 8*c*, various embodiments of the structured surfaces are represented. An equally distributed, low speed through the structure can be made possible for example by these different configurations (tapering (FIG. 8*a*), hyperbolically tapering (FIG. 8*b*), sinusoidally tapering) (FIG. 8*c*). An equally distributed speed through the structure is advantageous in order to use all regions of the structure optimally for the heat exchange. According to the arrangement, less compressed and more compressed regions in the structure can vary along the fabric structure (FIG. 7, (12)) and further promote uniform distribution.

Figure 8D:
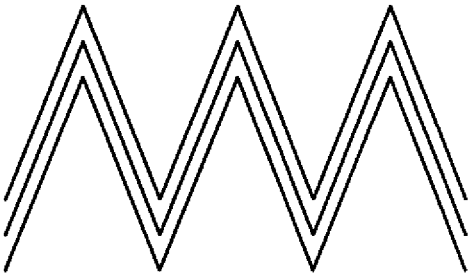

In FIG. 8*d*, an embodiment with a plurality of folded structures connected in succession is illustrated. As a result, a further increase in the heat exchanger surface can be produced on a small constructional space and hence an increase in power density in the case of a small increase in pressure loss.

The invention claimed is:

1. Heat transfer device comprising one or more channels for a heat-absorbing medium and one or more channels for a heat-emitting medium, at least one channel of the one or more channels for a heat-absorbing medium or the one or more channels for a heat-emitting medium having a textile structure, at least in regions, and the textile structure having compressed regions extending a width of a respective channel and being separated by spacings of a same length in a first direction, at least one of the compressed regions including multiple compressions in the respective channel, the compressed regions of the textile structure being disposed in a transition region between at least one channel of the one or more channels for a heat-absorbing medium and at least one channel of the one or more channels for a heat-emitting medium for production of a thermal contact and non-compressed regions of the textile structure being disposed in a flow region of at least one channel of the one or more channels for a heat-absorbing medium or the one or more channels for a heat-emitting medium, the textile structure including wires, technical fibres or yarns hereof, and the compressed regions having a plurality of horizontal spacings, wherein the horizontal spacings are located between the non-compressed regions, at least two of the plurality of horizontal spacings are of different lengths.

2. Heat transfer device according to claim 1, wherein the one or more channels for the heat-absorbing media are separated from the one or more channels for the heat-emitting media by a separating wall.

3. Heat transfer device according to claim 2, wherein the compressed regions in the transition region of the channels are connected integrally to the separating wall, at least in regions.

4. Heat transfer device according to claim 1, wherein the textile structure at the compressed regions has a coating which is impermeable or partially permeable for the heat-absorbing medium and the heat-emitting medium.

5. Heat transfer device according to claim 1, wherein, for separation of adjacent channels, in at least one channel, a first expandable hose or tube which is impermeable for the heat-absorbing medium and the heat-emitting medium is integrated, which enables contacting the textile structure by widening and/or shrinking, and/or, for separation of adjacent channels, around the at least one channel, a second shrinkable hose or tube which is impermeable for the heat-absorbing medium and the heat-emitting media is disposed, which enables contacting the textile structure by widening and/or shrinking.

6. Heat transfer device according to claim 1, wherein the textile structure is permeated, at least in regions, by a fluid for heat exchange.

7. Heat transfer device according to claim 1, wherein the textile structure is embedded, at least in regions, by a latently heat-storing, sorptive or catalytic stationary medium or is coated therewith on the surface.

8. Heat transfer device according to claim 1, wherein the wires, technical fibres or yarns thereof have a diameter of 10 μm to 2 mm.

9. Heat transfer device according to claim 1, wherein the wires, technical fibres or yarns hereof have, in flow direction, a spacing of 20 μm to 20 mm.

10. Heat transfer device according to claim 1, wherein the wires, technical fibres or yarns hereof are selected from the group consisting of metallic materials and the alloys thereof, carbon-containing materials, glass- or ceramic fibres, polymer materials, and composite materials hereof.

11. Heat transfer device according to claim 1, wherein the textile structure is a woven, knitted or warp-knitted structure or a combination hereof.

12. Heat transfer device according to claim 1, wherein, in the heat transfer device, lighting elements are integrated.

13. Heat transfer device according to claim 1, wherein, in the heat transfer device, at least one heating wire is integrated.

14. Heat exchanger comprising the heat transfer device according to claim 1.

15. Heat exchanger according to claim 14, wherein the heat exchanger is a plate heat exchanger, a tubular heat exchanger, a tubular lamellar heat exchanger, a flat tube lamellar heat exchanger or a coaxial heat exchanger.

* * * * *